US005577885A

United States Patent [19]

Urlichs

[11] Patent Number: 5,577,885

[45] Date of Patent: Nov. 26, 1996

[54] CONDENSING TURBINE HAVING AT LEAST TWO SEALS FOR SEALING OFF THE TURBINE CASING

[75] Inventor: Karl Urlichs, Nürnberg, Germany

[73] Assignee: ABB Patent GmbH, Mannheim, Germany

[21] Appl. No.: 495,860

[22] Filed: Jun. 28, 1995

[30] Foreign Application Priority Data

Jun. 28, 1994 [DE] Germany ..... 44 22 594.6

[51] Int. Cl.[6] ..... F01D 3/02; F01D 3/04

[52] U.S. Cl. ..... 415/105; 415/106; 415/107; 415/112; 415/113; 415/26; 415/47; 415/118; 415/231

[58] Field of Search ..... 415/104, 105, 415/106, 107, 111, 112, 113, 118, 168.2, 168.4, 230, 231, 13, 26, 29, 47; 217/2, 28, 96.1; 73/46, 49.8

[56] References Cited

U.S. PATENT DOCUMENTS

| | | | |
|---|---|---|---|
| 3,392,983 | 7/1968 | Hajner | 277/2 |
| 4,557,664 | 12/1985 | Tuttle et al. | 415/230 |
| 4,993,917 | 2/1991 | Kulle et al. | 415/107 |
| 5,375,853 | 12/1994 | Wasser et al. | 277/96.1 |

FOREIGN PATENT DOCUMENTS

| | | | |
|---|---|---|---|
| 3119467 | 12/1982 | Germany . | |
| 3815679 | 1/1992 | Germany . | |
| 0192803 | 11/1984 | Japan | 415/230 |
| 0226206 | 12/1984 | Japan | 415/26 |
| 0187897 | 7/1992 | Japan | 415/230 |
| 0231103 | 9/1993 | Japan | 415/29 |

*Primary Examiner*—Edward K. Look
*Assistant Examiner*—Christopher Verdier

[57] ABSTRACT

A condensing turbine includes a live-steam inlet, an exhaust-steam outlet and at least two seals for sealing off a turbine casing in the region of a turbine shaft carrying a turbine rotor. At least one of the seals is disposed on the live-steam side and one of the seals is disposed on the exhaust-steam side. The overall construction is substantially simplified by constructing at least one respective seal as a gas-lubricated mechanical surface seal on both the live-steam side and the exhaust-steam side. The outermost mechanical surface seals in each case on the live-steam side and the exhaust-steam side seal off separate seal spaces which are acted upon through a balancing line by an identical vacuum lying below the outer atmospheric pressure. These mechanical surface seals are constructed and fitted in such a way that a flow which is necessary for gas lubrication can occur through the mechanical surface seals from the outer atmosphere into the interior of the casing.

20 Claims, 3 Drawing Sheets

We
GL
DRb
Wb
AD
B
R
TG
FD
5
Δpk
K1
V
DRc
DS
6
Wc
Δpw
DS
AG
DRa
9
7
1
8
2
3
4
10
Wa
TW
GL
AL

"Prior Art"

CONDENSING TURBINE HAVING AT LEAST TWO SEALS FOR SEALING OFF THE TURBINE CASING

BACKGROUND OF THE INVENTION

1. Field of the Invention

The invention relates to a condensing steam turbine having a live-steam inlet, an exhaust-steam outlet and at least two seals for sealing off the turbine casing in the region of a turbine shaft carrying a turbine rotor, at least one of the seals is disposed on the live-steam side and one of the seals is disposed on the exhaust-steam side.

Steam turbines are used in one type of construction as back-pressure turbines when the steam on the outlet side is to be utilized in a heat network at increased pressure. In another type of construction designated as a condensing turbine, the heat content of the steam is utilized by its complete expansion down to a vacuum relative to the atmosphere. The consequence thereof is that the outer seals of a condensing turbine must be suitable for preventing the ingress of air into the turbine casing which is filled with steam.

The cost for the sealing measures in the prior art shown in FIG. 3 and described below is exceptionally high, since the quantities of steam escaping also have to be discharged in a barrier-steam condenser and since the steam states for the barrier steam to be used have to be separately adapted to the temperatures of the hot turbine inlet and the turbine outlet.

Furthermore, it is known to use mechanical surface seals in turbomachine construction in stationary compressors and in aircraft engines. German Published, Non-Prosecuted Application DE 35 33 829 A1 discloses a seal construction that is especially suitable for the balancing piston of a steam turbine. The use of that seal instead of an inner balancing-piston labyrinth in a steam turbine is described. In that case a lifting device is intended to prevent damage from occurring in the region of the seal during the warm-up and condensing phase of the steam. The lifting device is also suitable for protecting the stoppage and turning operation of a turbine.

SUMMARY OF THE INVENTION

It is accordingly an object of the invention to provide a condensing turbine having at least two seals for sealing off a turbine casing, which overcomes the hereinafore-mentioned disadvantages of the heretofore-known devices of this general type and which does not need expensive barrier-steam devices, numerous pipelines and condensing devices and yet prevents the penetration of outside air into the interior of the turbine under a vacuum.

With the foregoing and other objects in view there is provided, in accordance with the invention, a condensing turbine, comprising a turbine casing having an interior, a live-steam side with a live-steam inlet and an exhaust-steam side with an exhaust-steam outlet; a turbine shaft passing through the turbine casing; a turbine rotor being carried by the turbine shaft; a balancing line; and at least two seals for sealing off the turbine casing in the region of the turbine shaft, at least one of the seals being an outer gas-lubricated mechanical surface seal disposed on the live-steam side and at least one of the seals being an outer gas-lubricated mechanical surface seal disposed on the exhaust-steam side; the outer mechanical surface seals each sealing off a separate seal space being acted upon through the balancing line by an identical vacuum lying below an outer atmospheric pressure; and the mechanical surface seals being constructed and fitted for conducting a flow necessary for gas lubrication through the mechanical surface seals from an outer atmosphere into the interior of the casing.

With the objects of the invention in view, there is also provided a condensing turbine, comprising a turbine casing having a live-steam side with a live-steam inlet and an exhaust-steam side with an exhaust-steam outlet; a turbine shaft passing through the turbine casing; a turbine rotor being carried by the turbine shaft; at least two seals for sealing off the turbine casing in the region of the turbine shaft, at least one of the seals being a gas-lubricated mechanical surface seal disposed on the live-steam side and at least one of the seals being a gas-lubricated mechanical surface seal disposed on the exhaust-steam side; the at least one mechanical surface seal on the live-steam side acting as a balancing-piston seal for sealing off the passage of the turbine shaft through the turbine casing; and an axial bearing of the turbine shaft for absorbing uncompensated thrusts acting on the turbine shaft.

A mechanical surface seal which is constructed or fitted in such a way that the flow required for the gas lubrication can occur through the mechanical surface seal from the outer atmosphere into the interior of the casing enables a condensing turbine to be constructed in which at least one seal is constructed as a gas-lubricated mechanical surface seal on each of the live-steam side and the exhaust-steam side. The outermost mechanical surface seals on each of the live-steam side and the exhaust-steam side in this case are allocated to separate seal spaces which are acted upon through a balancing line by an identical vacuum lying below the outer atmospheric pressure.

The construction of the condensing turbine is considerably simplified by the use of a mechanical surface seal of that type, since the steam space is protected from air penetration in all operating states. In particular, this also applies to the stoppage and the so-called turning operation in which the turbine shaft, by slow turning with a suitable device, is protected from distortion through heating on one side. With the configuration described above, the outer shaft labyrinth being formed of a plurality of labyrinth seals can be replaced on the live-steam and the exhaust-steam side by one mechanical surface seal each, which reliably performs its tasks in all operating states. Expensive barrier-steam devices, numerous pipelines and condensing devices can be dispensed with. Water-vapor extraction, if necessary, is carried out as in the conventional embodiment according to FIG. 3.

In a further development of the subject matter of the invention, the mechanical surface seal can be fitted in the condensing turbine in such a way that a flow occurs through its sealing gap either from the inner to the outer diameter of this mechanical surface seal or the other way around.

Therefore, in accordance with another feature of the invention, there is provided an aerodynamically acting pattern to be integrated in the sealing surfaces of the mechanical surface seals, with the direction of action of the pattern corresponding to the intended flow through the mechanical surface seals from the outer atmosphere into the interior of the casing.

In order to relieve the axial bearing, steam turbines having single-flow construction with regard to the main flow are normally provided with a balancing piston which requires the use of a further seal.

Therefore, in accordance with a further feature of the invention, there is provided a balancing-piston seal to be inserted on the live-steam side behind the outermost mechanical surface seal, the balancing-piston seal being likewise constructed as a mechanical surface seal.

In accordance with an added feature of the invention, the turbine rotor has blading, and the axial bearing of the turbine shaft absorbs residual thrusts of the blading acting on the turbine shaft and not being balanced by a balancing piston.

In accordance with an additional feature of the invention, the axial bearing of the turbine shaft absorbs thrusts acting on the turbine shaft in both axial directions during idling and during full load.

Due to the fact that a mechanical surface seal acting as a balancing-piston seal also seals off the shaft passage through the turbine casing on the live-steam side, one mechanical surface seal and thus an expensive component can be eliminated. In turbines in which the remaining residual thrust originates only from a pressure difference of about 1 bar being used up in the turbine stages, the axial bearing can be dimensioned in such a way that it can absorb these forces. In this case, it is possible to dimension the axial bearing of the turbine shaft for both axial directions in such a way that it absorbs the thrusts during full load and during idling in an optimum manner.

In the case of the mechanical surface seal, a substantial problem is that, at very low rotational speeds of the turbine rotor, such as occur during starting operation or also from time to time during turning operation, the aerodynamic expansion of the seal gap does not take place or does not take place to an adequate extent and the sealing surfaces are thereby exposed to increased wear.

Therefore, in accordance with yet another feature of the invention, there are provided auxiliary means which provide for adequate expansion of the sealing gap during starting operation or during turning operation.

In accordance with yet a further feature of the invention, in an adoption of the concepts found in German Published, Non-Prosecuted Application DE 35 33 829 A1, the auxiliary means required for the expansion are formed of mechanically acting elements which then permit opening of the sealing gap to the required width during starting operation and during turning operation.

In accordance with yet an added feature of the invention, as an alternative, the auxiliary means required for the expansion are constructed so as to act aerodynamically, with a steam feed being effected into a seal space enclosing the balancing-piston seal, and the steam feed being controlled through a valve and thus being able to be shut off in normal operation when the seal space is at a sufficient positive pressure. This is especially necessary in the case of condensing turbines, in which sufficient flow through the seal for separate cooling would not occur in vacuum operation.

In accordance with yet an additional feature of the invention, the risk arising in the event of a fracture in a mechanical surface seal on the live-steam side is counteracted by at least one conventional labyrinth seal being disposed upstream as an emergency seal.

In accordance with again another feature of the invention, there is provided a conventional labyrinth seal disposed downstream of the mechanical surface seal on the live-steam side, which fulfills the same purpose as an emergency seal.

In accordance with again a further feature of the invention, as a further safety measure, there is provided at least one labyrinth seal acting as an emergency seal, at which a pressure difference in front of and behind the seal is measured and emergency shut-down of the steam turbine is effected if a predetermined limit value is exceeded.

In accordance with a concomitant feature of the invention, deformations impairing the sealing action of the mechanical surface seal are avoided by the mechanical surface seal and a seal casing accommodating it not being split but by being slipped as closed ring parts onto the turbine rotor upon assembly.

Other features which are considered as characteristic for the invention are set forth in the appended claims.

Although the invention is illustrated and described herein as embodied in a condensing turbine having at least two seals for sealing off the turbine casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
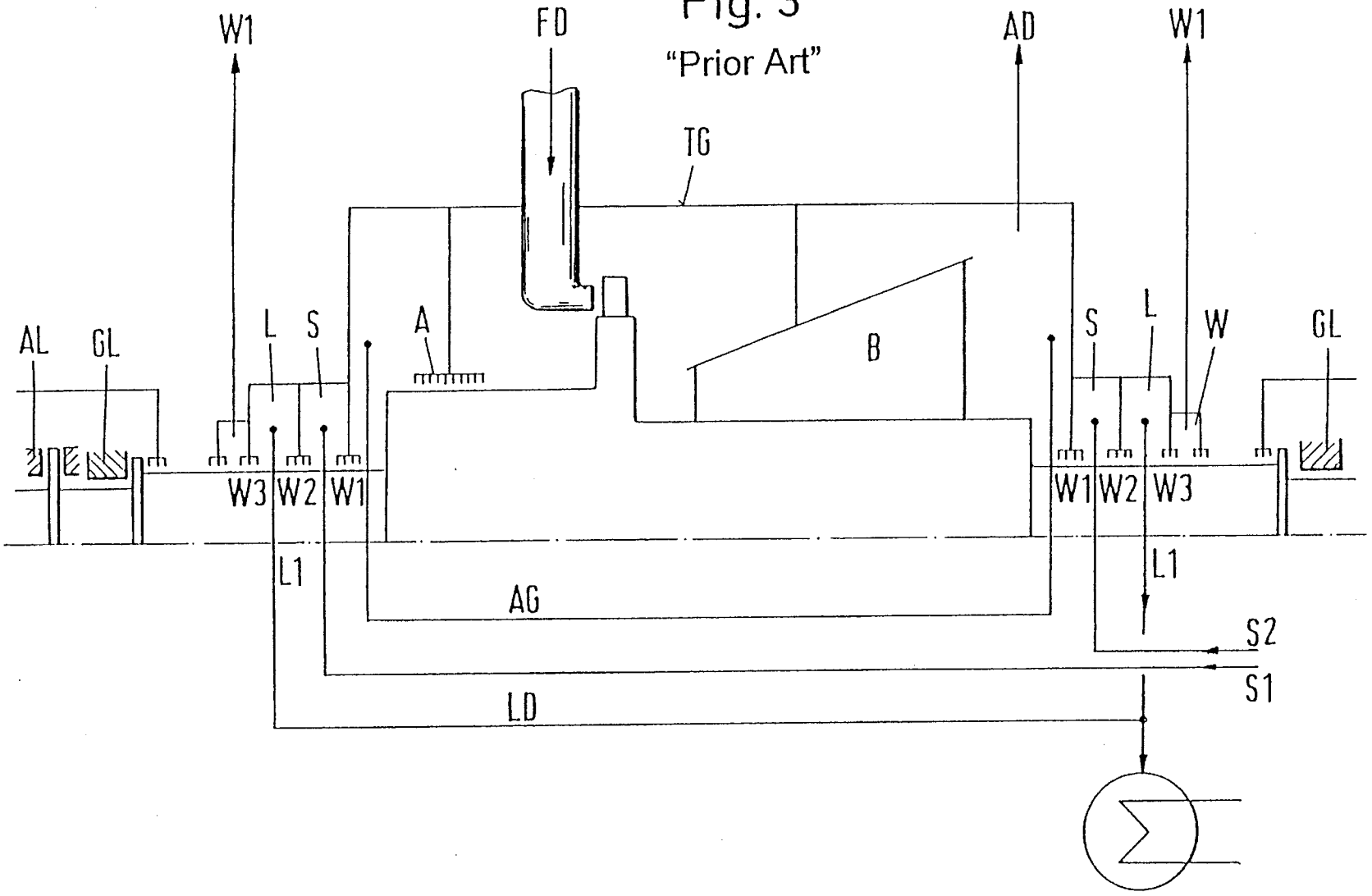
FIG. 3 is a view similar to FIGS. 1 and 2 of a prior art turbine casing of a condensing turbine in which seals are non-contacting labyrinths.

Referring now to the figures of the drawing in detail and first, particularly, to FIG. 3 thereof, there is seen a prior art structure according to which seals W1 of a turbine casing of a condensing turbine are constructed in a non-contact manner in the form of labyrinths. In this type of seal, suitable measures must be taken to obtain an improvement in the sealing effect. In general, this improved sealing is performed on the live-steam and exhaust-steam side by a further seal W2 which, as is seen from the interior of the casing, is disposed behind the actual shaft seal W1, and the improved sealing is also performed by an annular chamber S lying between the seals W1 and W2 and being acted upon by barrier steam S1, S2. The pressure of this steam is selected to be just so large that a flow takes place to the outside in all cases and thus an ingress of air is impossible. Leakage steam L1 flowing through the outer seal must in turn be prevented from escaping into the atmosphere by suitable annular chambers L and labyrinth seals W3. Finally, a chamber W ensures that the remaining leakage-steam/air mixture can be reliably extracted. The other elements shown in FIG. 3 are described below in the description of the invention.

The cost for the sealing measures described above is exceptionally high, since the quantities of steam escaping also have to be discharged in a barrier-steam condenser and since the steam states for the barrier steam S1, S2 to be used have to be separately adapted to the temperatures of the hot turbine inlet and the turbine outlet.

Figures 1, 1B:
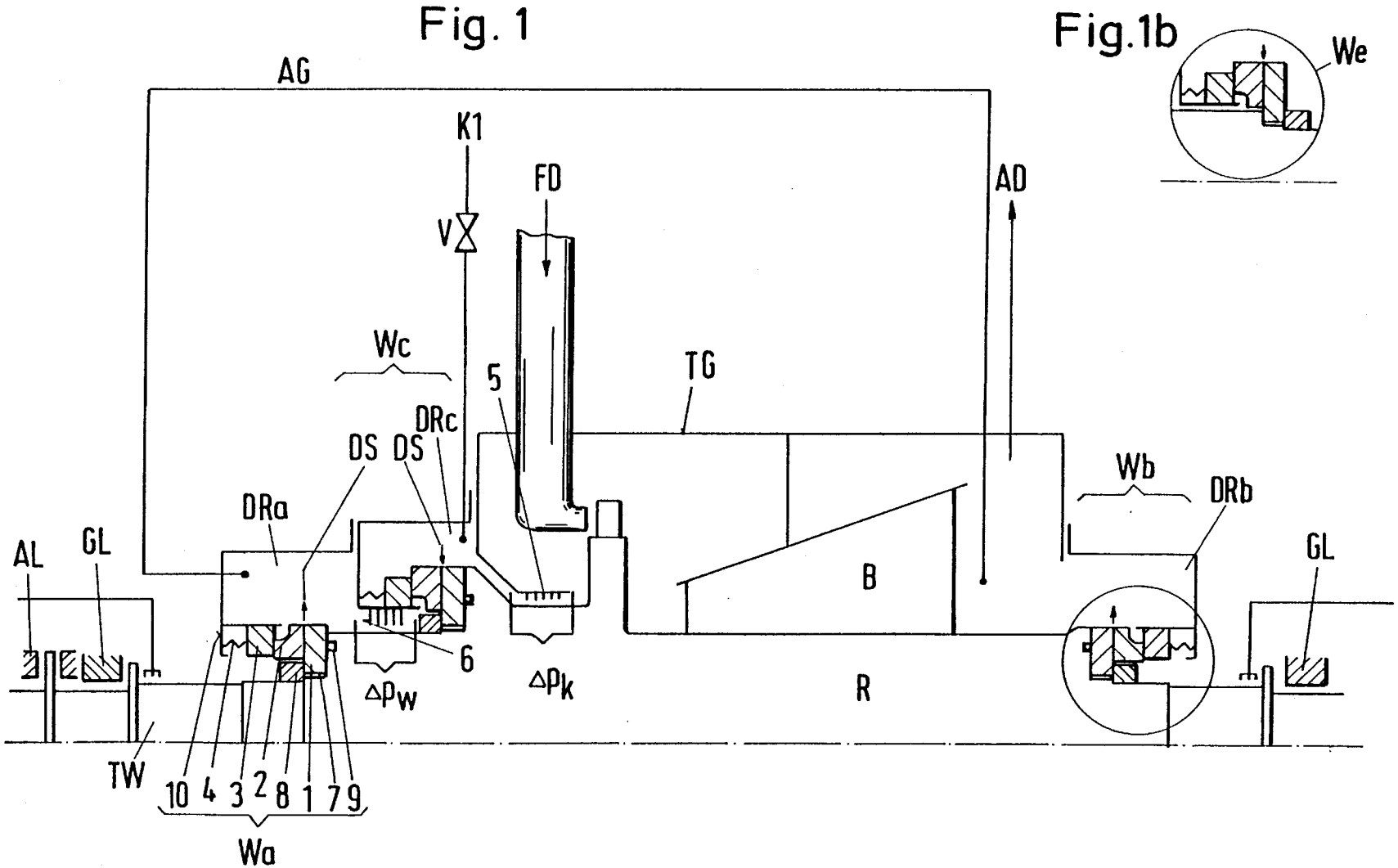
FIG. 1 is a fragmentary, diagrammatic, partly-sectional view of a condensing turbine with virtually complete balancing of axial thrust forces.
FIG. 1*b* is a view similar to a portion of FIG. 1 showing a different mechanical surface seal.
Figure 2:
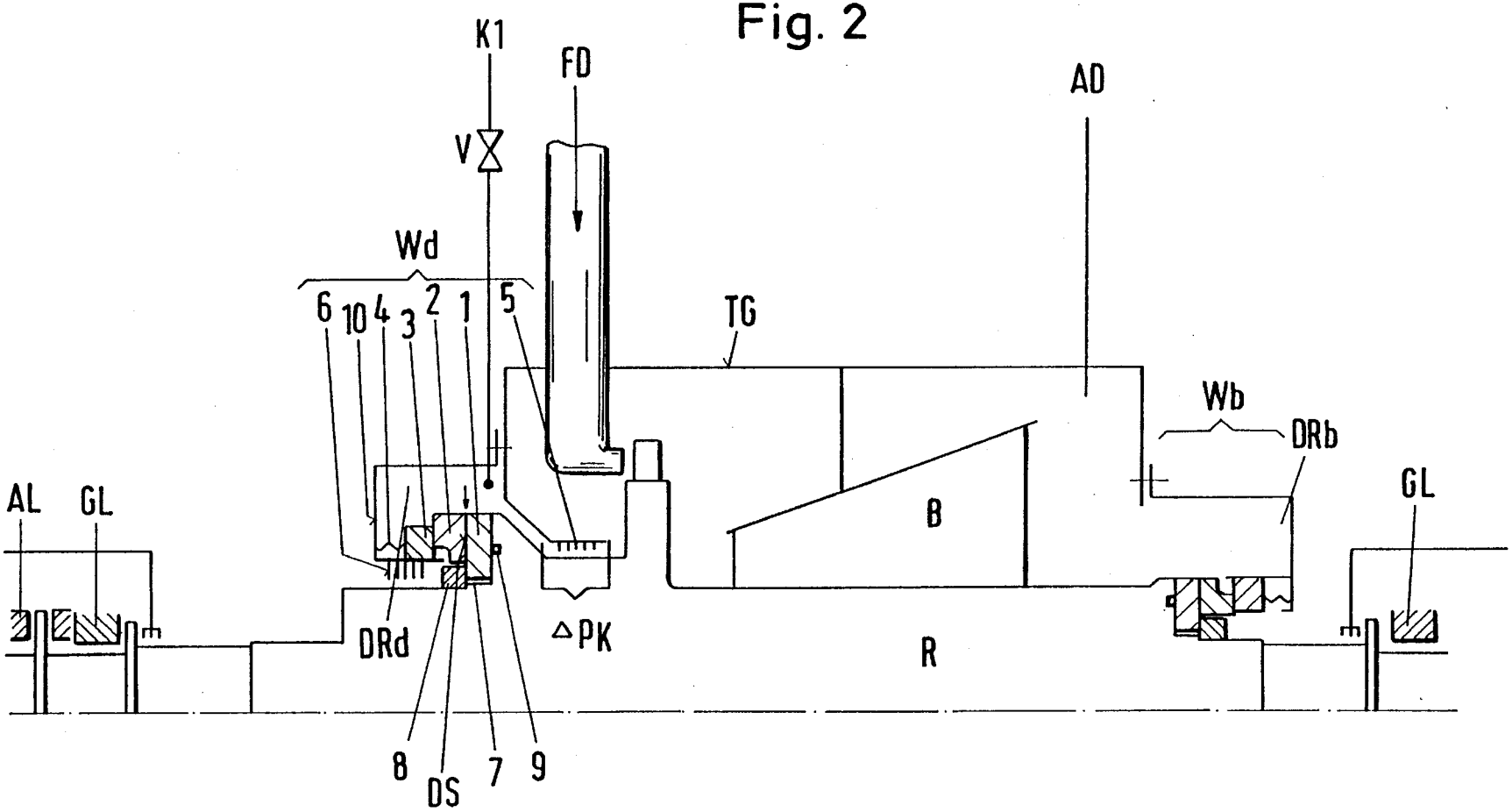
FIG. 2 is a view similar to FIG. 1 of a condensing turbine without hydrostatic balancing of the condensing part.

The construction of a mechanical surface seal Wa, Wb, Wc with its essential parts, as is used in the examples according to the invention, is shown in FIGS. 1 and 2. The mechanical surface seal which is suitable for high temperatures has a non-rotating sliding ring 2 which is movably connected by a secondary seal 3 to a turbine casing TG or a seal casing 10. The sliding ring 2 is pressed by springs 4, through the secondary seal 3, against a rotating mating ring 1 or a turbine shaft TW itself. A sealing gap DS lies between the two rings 1 and 2. For reasons of geometrical accuracy, the mating ring 1 which is rotating with the turbine shaft TW can also be carried by a precision intermediate ring. It is therefore centered by an elastically acting centering element 7 and held by a fastening element 8. A sealing ring 9 prevents a leakage flow between the sliding ring 2 and a rotor R.

Through the use of a configuration of the sealing gap DS of the mechanical surface seal with a special pattern at opposite sealing surfaces, through which gap-opening pockets having a depth of a few micrometers develop, hydrodynamic expansion of the sealing gap is achieved and as a result, with assistance from the rotation of the mating ring 1, small quantities of the fluid to be sealed are delivered through the seal. As compared with conventional non-contact labyrinth seals, the quantity passing through is so slight that it does not disturb the turbine operation. The fluid can be removed in the condenser by an extraction system.

The condensing turbine shown in FIG. 1 permits virtually complete balancing of the axial thrust forces. The rotor R with its blading B is located in the turbine casing TG and lies with its turbine shaft TW on both sides in a plain or sliding bearing GL. It has at least one axial bearing AL for absorbing the residual axial thrusts. Furthermore, a feed of live steam FD and a discharge of exhaust steam AD is indicated in the diagrammatic representation.

The three mechanical surface seals Wa, Wb, Wc of the condensing turbine include two outer mechanical surface seals Wa, Wb which seal off the passage of the turbine shaft TW through the turbine casing TG. Seal spaces DRa, DRb belonging to these mechanical surface seals Wa, Wb are connected to one another through a balancing line AG and have a vacuum of about 0.04 bar. Unlike the use in other turbomachines, due to this vacuum it is necessary to construct or place the mechanical surface seals in such a way that a flow against the sealing gap DS from outside to inside brings about gas lubrication and the flow medium in this case is not steam but air. In the configuration shown, flow occurs through the mechanical surface seals Wa, Wb in the direction from their inner to their outer diameter so that the aerodynamically acting pattern has to be disposed accordingly. However, the mechanical surface seals Wa, Wb can also be fitted in a different manner, e.g. in the form of a mechanical surface seal We as is shown in FIG. 1*b*. In all representations, the respective direction of flow at the sealing gap DS is identified by an arrow.

The condensing turbine described above is provided with a balancing piston for the pressure balance, with the action of the balancing piston being guaranteed by the third mechanical surface seal acting as a balancing-piston seal Wc. The structure of the balancing-piston seal Wc corresponds to that of the other two mechanical surface seals Wa, Wb, but it is fitted in accordance with a conventional configuration, in which flow occurs through it from inside to outside. Under normal operating conditions, a positive pressure prevails in an associated seal space DRc, but this positive pressure can drop to a vacuum during turning operation. In this case, a steam feed K1 is provided through which a positive pressure sufficient for an incident flow can be restored. A valve V permits control of the steam pressure or shut-off of the steam feed during normal operation.

Through the use of the balancing-piston seal Wc at the balancing piston of a steam turbine, the efficiency of the turbine can be increased considerably. In addition, the construction cost for pipelines and the cost of reintroducing the steam into the turbine casing TG is considerably less.

In order to ensure that an undesirable escape of steam does not occur in the event of a fracture in the mechanical surface seals Wa, Wc on the live-steam side, an emergency seal 5 disposed upstream and an emergency seal 6 disposed downstream of the balancing-piston seal Wc, are provided.

Likewise, in order to increase safety, pressure differences of pressures Pw and Pk in front of and behind the emergency seals 5, 6 are detected, and such pressure differences can initiate an emergency shut-down of the turbine if admissible limit values are exceeded.

The condensing turbine according to FIG. 2 corresponds to FIG. 1 in its basic construction so that repetitions in this respect can be dispensed with. A crucial difference is that a balancing-piston seal Wd also assumes the function of sealing off the shaft passage on the live-steam side, so that the mechanical surface seal Wa according to FIG. 1 is eliminated. However, this results in the lack of a hydrostatic pressure balance of the condensing part. In order to absorb these pressures, the axial bearing AL must be of appropriate dimensions.

In order to avoid deformations in the region of the rings 1 and 2, unsplit seal casings 10 are used which can be assembled without opening the turbine casing.

I claim:

1. A condensing turbine, comprising:

a turbine casing having an interior, a live-steam side with a live-steam inlet and an exhaust-steam side with an exhaust-steam outlet;

a turbine shaft passing through said turbine casing;

a turbine rotor being carried by said turbine shaft;

a balancing line; and at least two seals for sealing off said turbine casing in the region of said turbine shaft, at least one of said seals being an outer gas-lubricated mechanical surface seal disposed on said live-steam side and at least one of said seals being an outer gas-lubricated mechanical surface seal disposed on said exhaust-steam side;

said outer mechanical surface seals each sealing off a separate seal space being acted upon through said balancing line by an identical vacuum lying below an outer atmospheric pressure; and said mechanical surface seals conducting a flow necessary for gas lubrication through said mechanical surface seals from an outer atmosphere into said interior of said casing.

2. The condensing turbine according to claim 1, wherein said mechanical surface seals have sealing surfaces in which an aerodynamically acting pattern is integrated, said pattern having a direction of action corresponding to an intended flow through said mechanical surface seals from the outer atmosphere into said interior of said casing.

3. The condensing turbine according to claim 1, wherein said mechanical surface seals include an outermost mechanical surface seal, and including another mechanical surface seal being constructed as a balancing-piston seal and being inserted on said live-steam side behind said outermost mechanical surface seal.

4. A condensing turbine, comprising:

a turbine casing having a live-steam side with a live-steam inlet and an exhaust-steam side with an exhaust-steam outlet;

a turbine shaft passing through said turbine casing;

a turbine rotor being carried by said turbine shaft;

at least two seals for sealing off said turbine casing in the region of said turbine shaft, at least one of said seals being a gas-lubricated mechanical surface seal disposed on said live-steam side and at least one of said seals being a gas-lubricated mechanical surface seal disposed on said exhaust-steam side;

said at least one mechanical surface seal on said live-steam side acting as a balancing-piston seal for sealing off the passage of said turbine shaft through said turbine casing; and an axial bearing of said turbine shaft for absorbing uncompensated thrusts acting on said turbine shaft.

5. The condensing turbine according to claim 4, wherein said turbine rotor has blading, and said axial bearing of said turbine shaft absorbs residual thrusts of said blading acting on said turbine shaft and not being balanced by said balancing piston seal.

6. The condensing turbine according to claim 4, wherein said axial bearing of said turbine shaft absorbs thrusts acting on said turbine shaft in both axial directions during idling and during full load.

7. The condensing turbine according to claim 4, wherein said balancing-piston seal has a sealing gap expanding during starting and turning operation.

8. The condensing turbine according to claim 3, wherein said balancing-piston seal has a sealing gap expanding during starting and turning operation.

9. The condensing turbine according to claim 7, including mechanically acting elements permitting expansion and opening of said sealing gap to a required width during the starting operation and during the turning operation.

10. The condensing turbine according to claim 8, including mechanically acting elements permitting expansion and opening of said sealing gap to a required width during the starting operation and during the turning operation.

11. The condensing turbine according to claim 7, wherein said sealing gap expands aerodynamically, said balancing-piston seal has a seal space enclosing said balancing-piston seal, and including a steam feed into said seal space producing a positive pressure during the turning operation, and a valve for shutting off said steam feed during normal operation.

12. The condensing turbine according to claim 8, wherein said sealing gap expands aerodynamically, said balancing-piston seal has a seal space enclosing said balancing-piston seal, and including a steam feed into said seal space producing a positive pressure during the turning operation, and a valve for shutting off said steam feed during normal operation.

13. The condensing turbine according to claim 4, including a labyrinth seal disposed upstream of said balancing-piston seal as an emergency seal.

14. The condensing turbine according to claim 3, including a labyrinth seal disposed upstream of said balancing-piston seal as an emergency seal.

15. The condensing turbine according to claim 4, including a labyrinth seal disposed downstream of said balancing-piston seal as an emergency seal.

16. The condensing turbine according to claim 3, including a labyrinth seal disposed downstream of said balancing-piston seal as an emergency seal.

17. The condensing turbine according to claim 4, including at least one labyrinth seal being associated with said balancing-piston seal and acting as an emergency seal, wherein a pressure difference in front of and behind said at least one labyrinth seal is measured and an emergency shut-down of the steam turbine is effected if a predetermined limit value is exceeded.

18. The condensing turbine according to claim 3, including at least one labyrinth seal being associated with said balancing-piston seal and acting as an emergency seal, wherein a pressure difference in front of and behind said at least one labyrinth seal is measured and an emergency shut-down of the steam turbine is effected if a predetermined limit value is exceeded.

19. The condensing turbine according to claim 4, including a seal casing accommodating at least one of said mechanical surface seals, at least one of said mechanical surface seal and said seal casing being unsplit and being slipped onto said turbine rotor as a closed ring part upon assembly.

20. The condensing turbine according to claim 1, including a seal casing accommodating at least one of said mechanical surface seals, at least one of said mechanical surface seal and said seal casing being unsplit and being slipped onto said turbine rotor as a closed ring part upon assembly.

* * * * *